US011987942B2

(12) United States Patent
Park et al.

(10) Patent No.: US 11,987,942 B2
(45) Date of Patent: May 21, 2024

(54) FINGER-TYPE EXPANSION JOINT DEVICE WITHOUT DRAINAGE SHEET

(71) Applicant: DAEBONG B.M.TECHNOLOGY CO., LTD, Busan (KR)

(72) Inventors: Daewon Park, Busan (KR); Junho Lee, Busan (KR)

(73) Assignee: DAEBONG B.M.TECHNOLOGY CO., LTD, Busan (KR)

( * ) Notice: Subject to any disclaimer, the term of this patent is extended or adjusted under 35 U.S.C. 154(b) by 235 days.

(21) Appl. No.: 17/762,080

(22) PCT Filed: Sep. 29, 2020

(86) PCT No.: PCT/KR2020/013412
§ 371 (c)(1),
(2) Date: Mar. 20, 2022

(87) PCT Pub. No.: WO2021/066568
PCT Pub. Date: Apr. 8, 2021

(65) Prior Publication Data

US 2022/0341106 A1 Oct. 27, 2022

(30) Foreign Application Priority Data

Oct. 2, 2019 (KR) ..... 10-2019-0122579
May 6, 2020 (KR) ..... 10-2020-0054109

(51) Int. Cl.
*E01D 19/06* (2006.01)
*E01D 19/08* (2006.01)

(52) U.S. Cl.
CPC ..... *E01D 19/065* (2013.01); *E01D 19/086* (2013.01)

(58) Field of Classification Search
CPC ..... E01D 19/065; E01D 19/086; E01D 19/06; E01D 19/062; E01C 11/02; E01C 11/08
See application file for complete search history.

(56) References Cited

U.S. PATENT DOCUMENTS 2,013,195 A * 9/1935 Ward ..... E01D 19/065 14/73.1
3,605,574 A * 9/1971 Hall ..... E01D 19/065 52/395
3,750,359 A * 8/1973 Balzer ..... E04B 1/681 52/468
6,460,214 B1 * 10/2002 Chang ..... E01D 19/06 14/73.1
10,087,591 B1 * 10/2018 Moore ..... E01D 19/065
2002/0138925 A1 * 10/2002 Chang ..... E01D 19/06 14/73.1

(Continued)

FOREIGN PATENT DOCUMENTS

JP 2007-032057 A 2/2007
KR 10-0662035 B1 12/2006

(Continued)

OTHER PUBLICATIONS

International Search Report of PCT/KR2020/013412 published on Apr. 8, 2021.
Written opinion of PCT/KR2020/013412 published on Apr. 8, 2021.

*Primary Examiner* — Abigail A Risic

(57) ABSTRACT

Provided is a finger type expansion joint not having a drainage sheet, including: first and second support members (10, 10'); a connection block plate (20); and a gap maintenance member (30).

6 Claims, 11 Drawing Sheets

(56) References Cited

U.S. PATENT DOCUMENTS

| | | | | |
|---|---|---|---|---|
| 2007/0044257 | A1* | 3/2007 | Xu | E01D 19/06 14/73.1 |
| 2007/0199267 | A1* | 8/2007 | Moor | E01D 19/06 52/393 |
| 2009/0064602 | A1* | 3/2009 | Lee | E01D 19/06 14/73.1 |
| 2012/0237295 | A1* | 9/2012 | Kawamoto | E01D 19/06 404/74 |
| 2017/0073910 | A1* | 3/2017 | Koo | E01D 19/06 |

FOREIGN PATENT DOCUMENTS

| | | | |
|---|---|---|---|
| KR | 10-0743043 | B1 | 7/2007 |
| KR | 10-0798654 | B1 | 1/2008 |
| KR | 10-1162754 | 81 | 7/2012 |
| KR | 10-1374606 | B1 | 3/2014 |
| KR | 10-1542536 | B1 | 8/2015 |
| KR | 10-2111779 | B1 | 5/2020 |

* cited by examiner

FINGER-TYPE EXPANSION JOINT DEVICE WITHOUT DRAINAGE SHEET

TECHNICAL FIELD

The disclosure relates to a finger type expansion joint not having a drainage sheet, which has swept away a disadvantage attributable to the drainage sheet part of an expansion joint installed to connect joint gaps in a road, a bridge, etc.

BACKGROUND OF THE INVENTION

In general, in a bridge including multiple bridge piers and having a relatively long length, in order to correspond to the expansion and contraction of the bridge according to a temperature change, the upper plate of the bridge is divided into several parts in the length direction of the bridge. An expansion joint is installed in an isolated space between the slabs of the upper plate between the divided parts.

Such an expansion joint has been developed as various structures. For example, the expansion joints are deployed to maintain given intervals in a way to face each other, and each includes a pair of support members on the outer surface of each thereof an anchor is provided, a pair of finger plates coupled to the horizontal stage of the support member in a way to be engaged with each other, and a drainage sheet part disposed between the support members on both sides thereof and made of a rubber material.

The drainage sheet part disposed between the support members on both sides thereof may be integrated with the support member by vulcanizing cementation depending on a structure or type of the expansion joint, and may have both faces (both ends) in the length direction thereof coupled to the vertical stages of the support members on both sides thereof after being separately fabricated.

The drainage sheet part of such an expansion joint is for preventing rainwater or an alien substance from being introduced between the support members on both sides. As a conventional technology, the construction of a drainage sheet part was disclosed in Korean Patent Nos. 10-743043, 10-662035, 10-1374606, and 10-1374606.

However, the structure of the conventional drainage sheet part has problems in that a construction coupled to the support members on both sides thereof is complex or inconvenient depending on a site, an alien substance is not smoothly drained if the an alien substance is accumulated on the drainage sheet part, and the drainage sheet part needs to be periodically managed, such as cleaning or replacement, because the drainage sheet part is easily damaged.

DISCLOSURE

Technical Problem

The present disclosure has invented a new technology in order to solve all the problems of the conventional technology, and an object of the present disclosure is to provide a finger type expansion joint not having a drainage sheet, which is constructed so that the existing drainage sheet part does not need to be installed by blocking rainwater or an alien substance from being drained between finger plates by actively improving the structure of an expansion joint essentially having the drainage sheet part in a conventional technology.

Furthermore, an object of the present disclosure is to provide an expansion joint having a leakage and vibration prevention function for highly improving shock mitigation, the prevention of loosening of bolts and watertightness between bolt fastening parts attributable to vehicle traffic.

Technical Solution

As detailed means for achieving the objects, the present disclosure includes first and second support members 10 and 10' in each of which a vertical support 12 is upward erect at one end of a sheet-shaped base plate 11 and a finger assembly mount 14 is disposed at the other end of the base plate 11 so that finger plates 2 and 2' are assembled by bolts B and which are installed in upper plates 1 and 1' on both sides of a bridge which face an isolated space, respectively, a connection block plate 20 which are installed to interconnect the first and second support members 10 and 10', support bottoms of the finger plates 2 and 2', and block water or an alien substance from being discharged between the finger parts 2*a* by providing blocking between the finger parts 2*a*, and a gap maintenance member 30 which is interposed between the first and second support members 10 and 10' and the connection block plate 20 and which places a location of the connection block plate 20 in a middle of the first and second support members 10 and 10' by an elastic action.

Furthermore, the connection block plate 20 includes a sheet-shaped cover plate 21. Seated supports 22 and 22' downward erect in a way to be closely attached to the base plates 11 of the first and second support members 10 and 10' at both ends of the cover plate 21, respectively, are constructed in the connection block plate 20 to cover and connect the first and second support members 10 and 10', respectively.

The gap maintenance member 30 is elastic foam 31. The elastic foam 31 includes one or more of outside elastic foam 32 interposed between each of the seated supports 22 and 22' and the finger assembly mount 14 to maintain a gap by an elastic action so that the connection block plate 20 is positioned in a middle of the elastic foam 31 or inside elastic foam 33 interposed between each of the seated supports 22 and 22' and the vertical support 12.

A protection cover 34 is further constructed at the bottom of each of the finger plates 2 and 2' to prevent the elastic foam 31 from being directly exposed to the outside.

Furthermore, packing means 40 for blocking water from being penetrated into a contact portion of the connection block plate 20 and each of the first and second support members 10 and 10' is further included. The packing means 40 includes a leakage prevention cap 41 fit into the bottom of each of the seated supports 22 and 22' closely attached to the base plate 11 or the top of the vertical support 12 closely attached to the cover plate 21 and compressed to form a sealing structure when pressurized by a load of each of the finger plates 2 and 2' in order to prevent water leakage and distribute a load.

Furthermore, separation prevention means 50 for constraining the side of each of the finger plates 2 and 2' at the rear end thereof to the finger assembly mount 14 in order to prevent each of the finger plates 2 and 2' from being detached from the finger assembly mount 14 due to upward soaring is further included. The separation prevention means 50 includes fasteners 51 downward protruded at the bottom of each of the finger plates 2 and 2' at the rear end thereof and formed in plural in a length direction. A pin hole 52 is penetrated into the fastener 51, a plurality of insertion grooves 53 is formed in a length direction of the finger assembly mount 14 so that the fasteners 51 of each of the finger plates 2 and 2' are fit into the insertion grooves 53. A coupling pin 54 fit into a pin hole 52 of the fastener 51 is constructed in the insertion groove 53 in a way to protrude toward the finger parts 2*a*.

Furthermore, a rubber tube 80 installed on an outer circumference surface of the bolt B to provide sealing between each of the finger plates 2 and 2' and the finger assembly mount 14 and between the bolt B and the finger assembly hole 13 is further included.

Furthermore, an end gradient pad 60 made of a compressible elastic body is disposed on the top of the connection block plate 20 and mitigates and supports bottoms of the finger plates 2 and 2' and also provides blocking between the finger parts 2*a*.

Furthermore, a tube fitting 70 for drainage is installed below the vertical support 12. The tube fitting 70 includes a drainage pipe 72 having one end connected to the tube fitting 70, the other end extended to the outside of each of the first and second support members 10 and 10' to discharge, to the outside, an alien substance stagnated in each of the first and second support members 10 and 10'.

Advantageous Effects

According to the finger type expansion joint not having a drainage sheet according to the present disclosure, the connection block plate connected to the upper plates on both sides thereof as a structure that covers the first and second support members constructs a structure that supports the bottom of the finger plates and also seals the finger part. Accordingly, there can be provided effects in that a construction is very convenient and an economic cost for repair and maintenance is reduced without installing a separate drainage sheet part for draining water and containing an alien substance because water or an alien substance is prevented from being drained into the isolated space between the finger plates.

Furthermore, there can be provided effects in that a shock is mitigation when a vehicle travels, the release of the bolt is prevented, and watertightness between bolt fastening parts is highly improved because the finger plates are fastened by the bolts through the medium of the rubber tubes.

Furthermore, a shock to the finger plate is mitigated and supported by the end gradient pad, and noise and a shock attributable to vehicle traffic is absorbed. In particular, there can be provided effects in that a gap between the finger parts is conjunctly blocked and damage attributable to friction between the finger part and the cover plate is prevented because the end gradient pad is flexibly elastically deformed although a gap between the finger part of the finger plate and the cover plate of the connection block plate is reduced in response to expansion and contraction movements of an inclined type bridge.

DETAILED DESCRIPTION OF THE INVENTION

Figure 1:
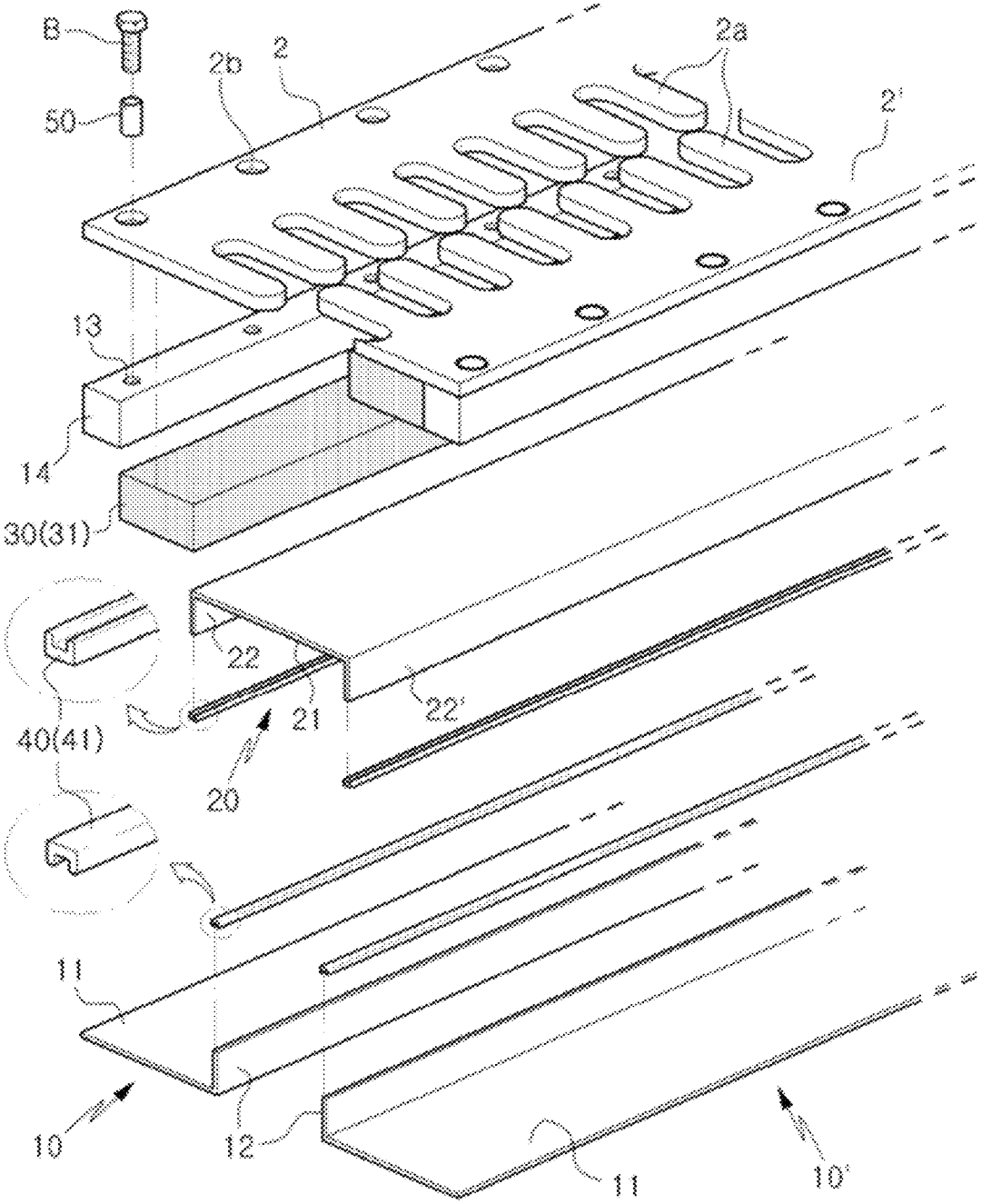
FIG. 1 is a separated perspective view illustrating a finger type expansion joint not having a drainage sheet according to the present disclosure.
Figure 2A:
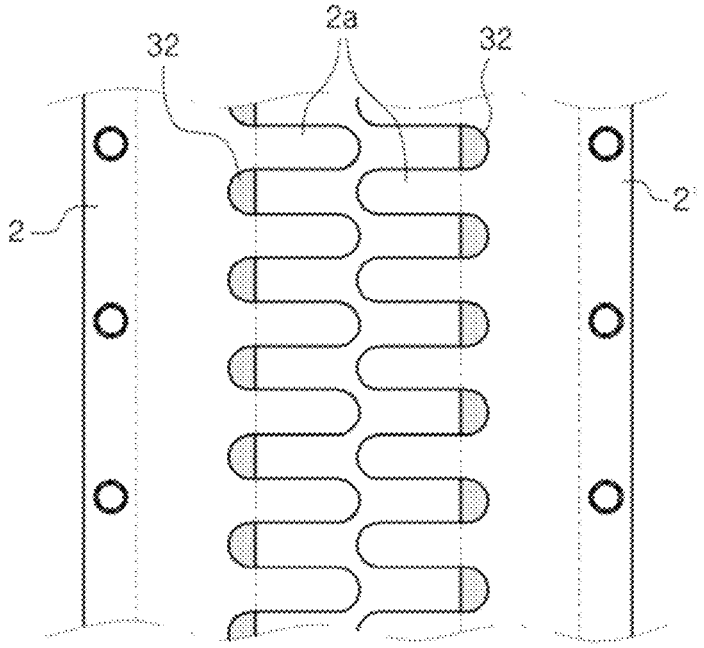
FIGS. 2A-2B are diagrams illustrating the coupling state of the finger type expansion joint not having a drainage sheet according to the present disclosure.
Figure 2B:
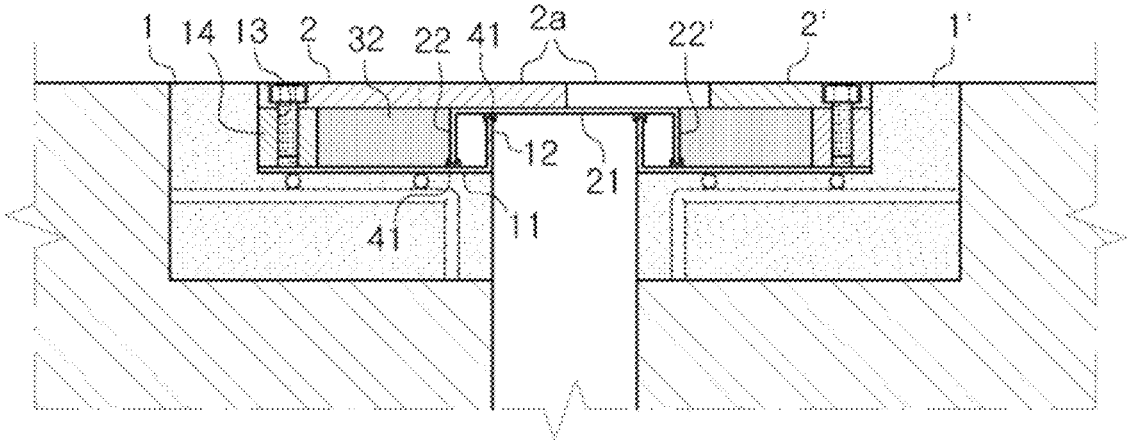
Figure 3A:
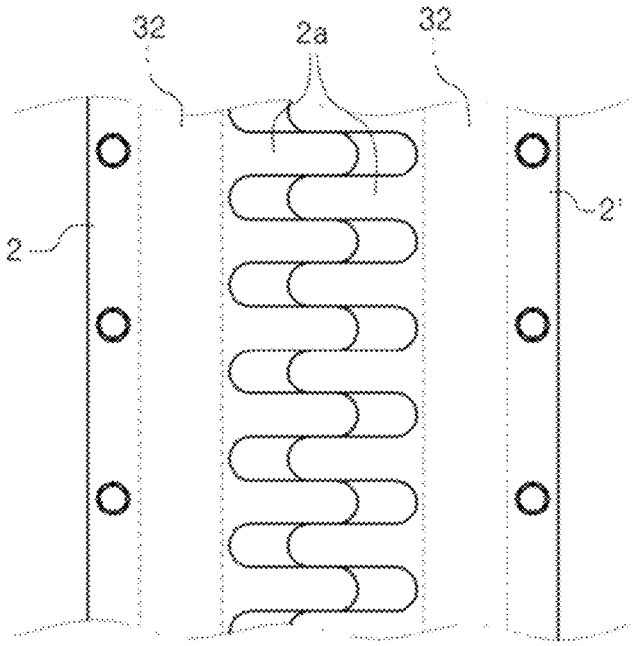
FIGS. 3A-3B and FIGS. 4A-4B are diagrams illustrating actions of FIG. 2.
Figure 3B:
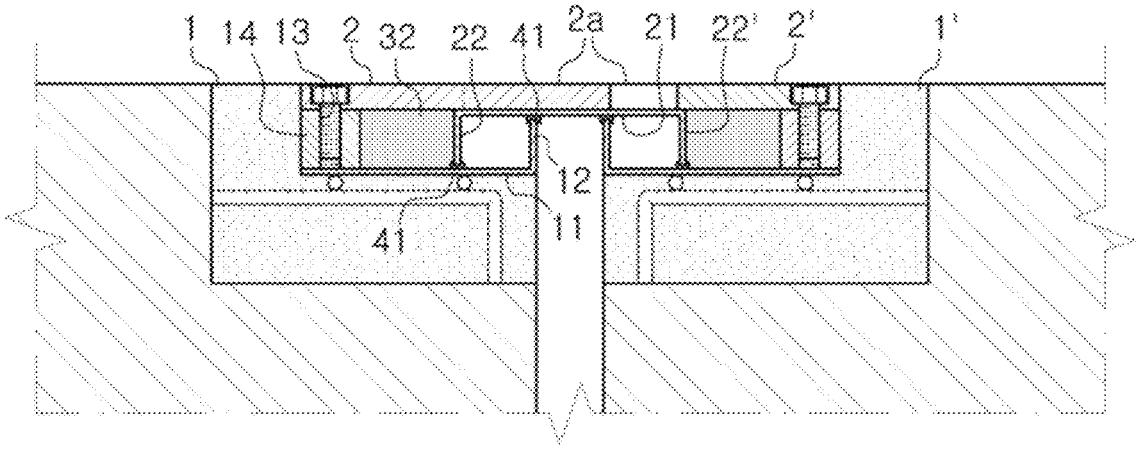
Figure 4A:
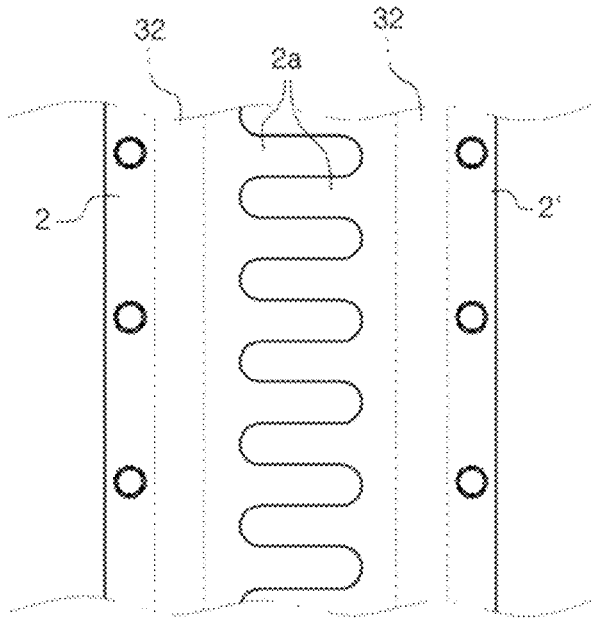
Figure 4B:
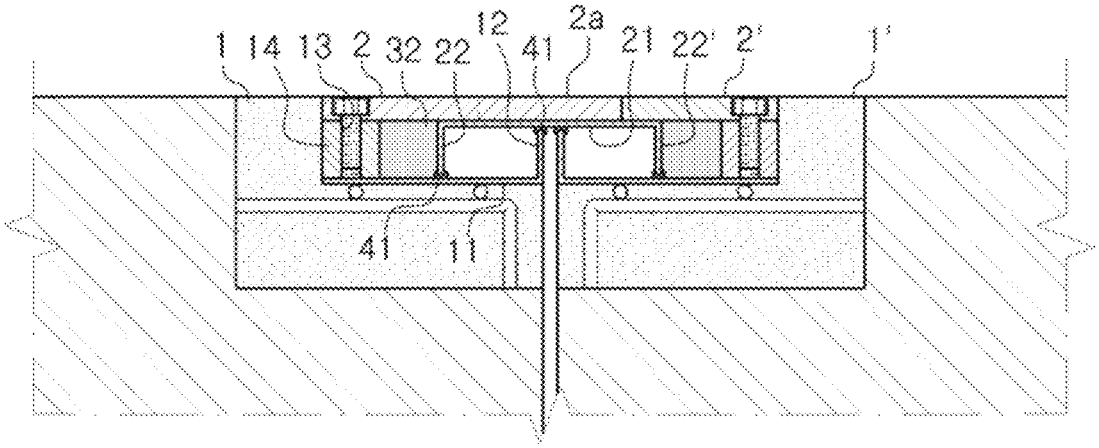

Hereinafter, the present disclosure is more specifically described based on detailed embodiments illustrated in the accompanying drawings. FIG. 1 is a separated perspective view illustrating a finger type expansion joint not having a drainage sheet according to the present disclosure. FIGS. 2A and 2B illustrate, respectively, a plan view and a sectional view of the state in which the expansion joint has been applied to a bridge.

The finger type expansion joint not having a drainage sheet according to the present disclosure has a technical characteristic in that it is constructed as a structure in which water or an alien substance is not drained between finger plates on both sides thereof, thereby making unnecessary a drainage sheet part.

The expansion joint according to the present disclosure includes first and second support members 10 and 10' installed in upper plates 1 and 1' on both sides of a bridge, which face each other an isolated space of the bridge, a connection block plate 20 coupled to interconnect the first and second support members 10 and 10', support the finger plates 2 and 2' and also block water or an alien substance from being drained between the finger parts 2*a* of finger plates 2 and 2', and a gap maintenance member 30 interposed between the first and second support members 10 and 10' and the connection block plate 20 so that a location of the connection block plate 20 is placed in the middle of the first and second support members 10 and 10'.

Each of the first and second support members 10 and 10' includes a sheet-shaped base plate 11, and is integrated with a vertical support 12 that is upward erect from the base plate 11 at each of inside front ends thereof facing each other.

Furthermore, a finger assembly mount 14 in which finger assembly holes 13 are formed is disposed in the rear of each of the first and second support members 10 and 10' in order to assembly the finger plates 2 and 2' by bolts. The finger assembly mounts 14 are preferably integrated with the first and second support members 10 and 10' by being welded in a fabrication process.

The connection block plate 20 includes a sheet-shaped cover plate 21. Seated supports 22 and 22' that are downward erect are formed at both ends of the cover plate 21 so that the seated supports 22 and 22' are closely attached to the base plates 11 of the first and second support members 10 and 10', thus covering and connecting the upper parts of the first and second support members 10 and 10'.

Referring to FIGS. 3A-3B and 4A-4B, when the first and second support members 10 and 10' are installed on both sides of the upper plates 1 and 1' as a structure in which the vertical supports 12 are upward erect, the seated supports 22 and 22' downward erect at both ends of the connection block plate 20 over the first and second support members 10 and 10' are covered to be seated in the base plates 11 of the first and second support members 10 and 10', respectively, and then the finger plates 2 and 2' on both sides of the expansion joint are assembled by the finger assembly mounts 14 of the first and second support members 10 and 10', the seated supports 22 and 22' are closely attached to the base plates 11 because the finger plates 2 and 2' are supported by the connection block plate 20 and the finger plates 2 and 2' also pressurize the connection block plate 20 by a given force.

As the connection block plate 20 having such a sheet shape seals isolated spaces formed under the finger plates 2 and 2', water or an alien substance is blocked from being drained between the finger parts 2*a*. In this case, the water or storm water is naturally induced and drained into a drainage facility in a road along the inclination of the expansion joint installed to have a gradient.

The gap maintenance member 30 of the present disclosure is an element for making the connection block plate 20 always placed in the middle of the first and second support members 10 and 10' when the expansion joint is expanded or contracted in order to smoothly provide a function for blocking the finger parts 2*a* of the finger plates 2 and 2' on both sides of the expansion joint in a way that the connection block plate 20 is installed and covered on the upper side of the first and second support members 10 and 10'.

For example, the gap maintenance member 30 may be elastic foam 31 inserted between each of the seated supports 22 and 22' and the finger assembly mount 14 to maintain the gap therebetween by an elastic action.

Figure 5A:
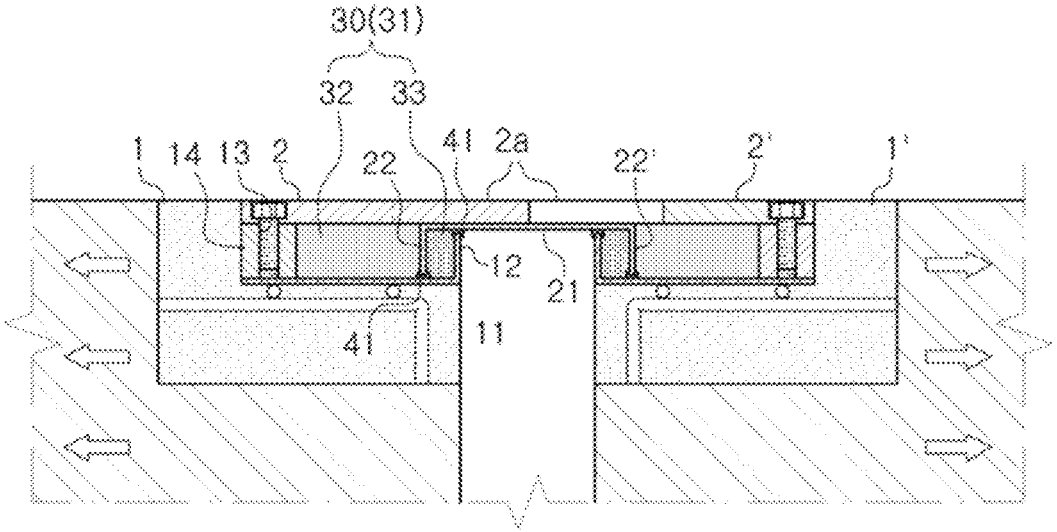
FIGS. 5A-5B are diagrams illustrating another embodiment of a gap maintenance member in a construction of the present disclosure.
Figure 5B:
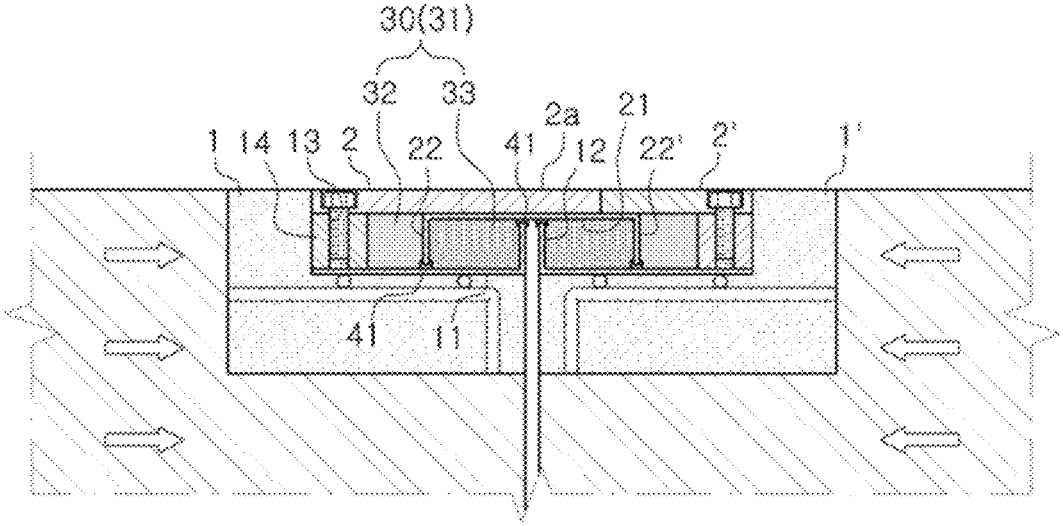

As illustrated in FIGS. 5A-5B, the elastic foam 31 may include outside elastic foam 32 interposed between each of the seated supports 22 and 22' and the finger assembly mount or inside elastic foam 33 interposed between each of the seated supports 22 and 22' and the vertical support 12.

The gap maintenance member 30 may sufficiently function to locate the position of the connection block plate 20 by the outside elastic foam 32, but may additionally further include the inside elastic foam 33 in order to more easily maintain the gap of the connection block plate 20 by a more firm elastic action upon expansion and contraction actions of the upper plates 1 and 1'.

Meanwhile, upon contraction action of the upper plates 1 and 1', the top of the outside elastic foam 32 of the elastic foam 31 may be exposed to the outside between the finger parts 2*a*, as illustrated in FIGS. 2A-2B.

Figure 6A:
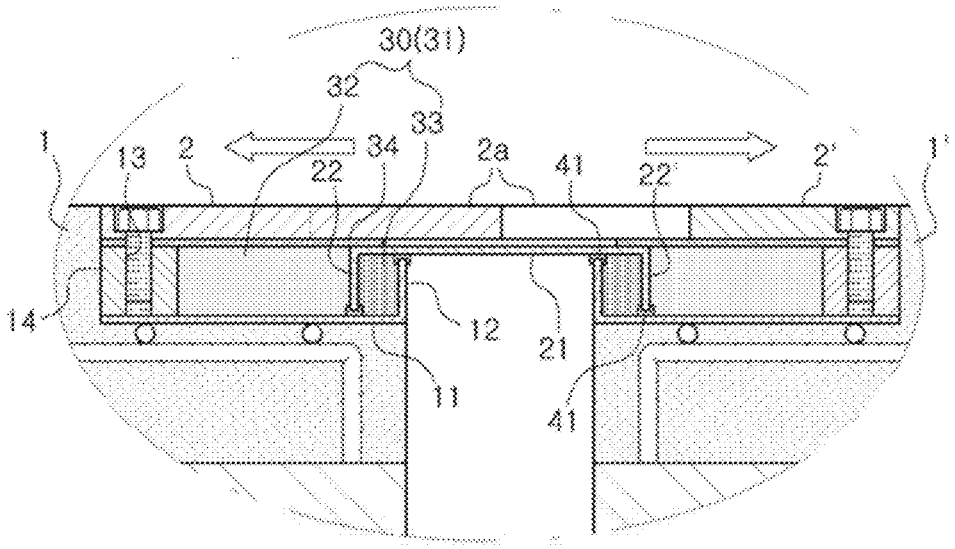
FIGS. 6A-6B are diagrams illustrating still another embodiment of the gap maintenance member in the construction of the present disclosure.
Figure 6B:
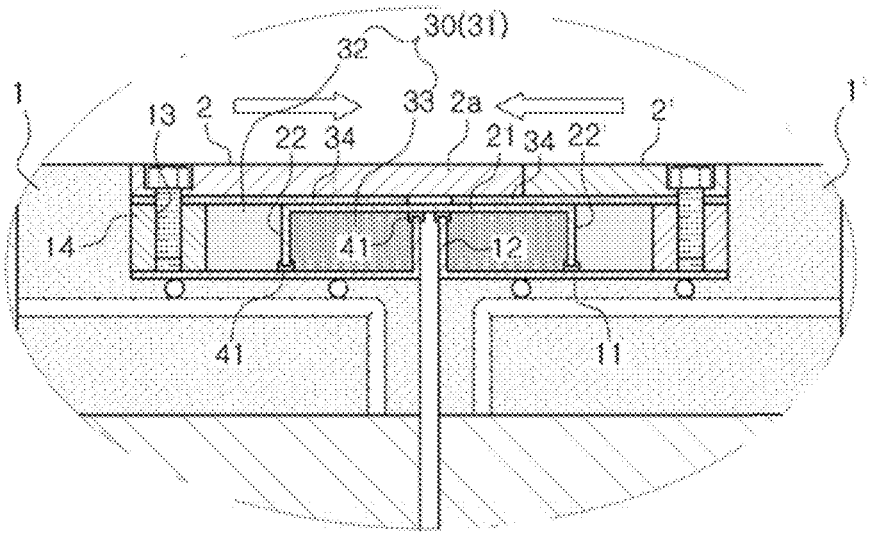

In this case, the outside elastic foam 32 may be damaged or a beautiful appearance of the expansion joint may be degraded due to a wheel of a traveling vehicle and various alien substances on a road. In order to prevent such damage or degradation, as illustrated in FIGS. 6A-6B, a protection cover 34 may be further constructed under each of the finger plates 2 and 2' in order to block the elastic foam 31 from being directly exposed to the outside.

Furthermore, as illustrated in FIGS. 2A-2B, the present disclosure may further include packing means 40 in a contact portion between the connection block plate 20 and each of the first and second support members 10 and 10'.

A leakage prevention cap 41 for preventing storm water from leaking by providing sealing between each of the seated supports 22 and 22' closely attached to the base plate 11 and each of the vertical supports 12 closely attached to the cover plate 21 is formed as an embodiment of the packing means 40.

The leakage prevention cap 41 is disposed below each of the seated supports 22 and 22' and on the top of the vertical support 12 in a way to be closely attached thereto in a fitted way. When the finger plates 2 and 2' are assembled in the state in which the leakage prevention cap 41 has been closely attached to the base plate 11 and the cover plate 21, the connection block plate 20 is downward pressurized by weight of the finger plates 2 and 2' and the leakage prevention cap 41 is also pressurized. Accordingly, water is fully prevented from being permeated between the seated supports 22 and 22' closely attached to the base plate 11 and the vertical support 12 closely attached to the cover plate 21 by the compression of the base plate 11 and the cover plate 21.

Meanwhile, the leakage prevention cap 41 is made of a material having elasticity for the purpose of elastic compression when applied pressure is formed, and provides a block function for preventing water leakage and a function for stably supporting the first and second support members 10 and 10' and the connection block plate 20 by inducing an action of uniformly distributing weight by the finger plates 2 and 2'.

Hereinafter, a process of assembling the expansion joint provided in the present disclosure is described.

After the first support member 10 and the second support member 10' are installed in the upper plates 1 and 1' on both sides thereof as a structure in which the vertical support 12 is upward erect, the connection block plate 20 is installed over the first and second support members 10 and 10' in a way to cover the first and second support members 10 and 10' so that the seated supports 22 and 22' are directed toward the lower side.

Furthermore, the elastic foam 31 is inserted between each of the first and second support members 10 and 10' and the connection block plate 20 so that the connection block plate 20 is placed in the middle.

The elastic foam 31 may be installed by adding the outside elastic foam 32 interposed between each of the seated supports 22 and 22' and the finger assembly mount 14 and the inside elastic foam 33 inserted between the vertical support 12 and each of the seated supports 22 and 22' in a way to assist to support the vertical support 12 and each of the seated supports 22 and 22' while maintain the gap therebetween.

After the gap maintenance member 30 is installed, the installation of the expansion joint is completed by fastening the finger assembly mount 14 and the finger plates 2 and 2' on both sides of the expansion joint by bolts B.

As described above, according to the present disclosure, the expansion joint itself can be constructed very convenience because the coupling structure of the first and second support members 10 and 10', the connection block plate 20, and the gap maintenance member 30 is simple.

In particular, there are no problems in that the assembly of the drainage sheet part is inconvenient and a construction is complex in a section in which the joint gap is narrow when a separate drainage sheet part is installed between the first and second support members 10 and 10' as in a conventional technology.

According to the present disclosure, as the connection block plate 20 is installed as a structure to cover the tops of the first and second support members 10 and 10', the connection block plate 20 is formed as a structure that supports the bottoms of the finger plates 2 and 2' and also blocks them in the state which the connection block plate 20 has been placed in the middle of the expansion joint by the elastic foams 31 interposed on both sides of the connection block plate 20. Water or an alien substance can be blocked from being drained between the finger parts 2*a* of the finger plates 2 and 2'.

Figure 7A:
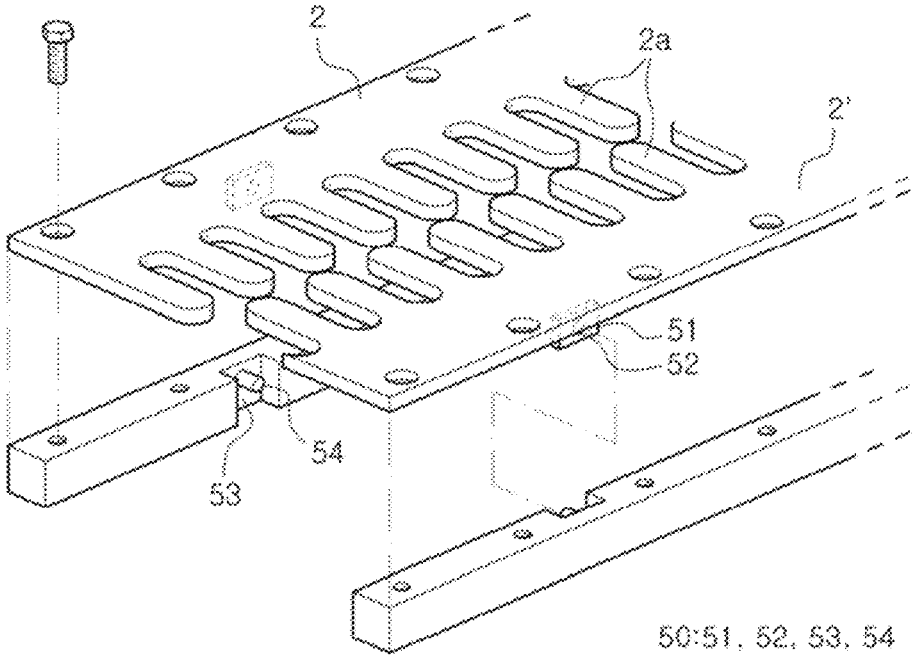
FIGS. 7A-7B are diagrams illustrating an embodiment in which separation prevention means is additionally constructed in the finger plate of the finger type expansion joint not having a drainage sheet according to the present disclosure.
Figure 7B:
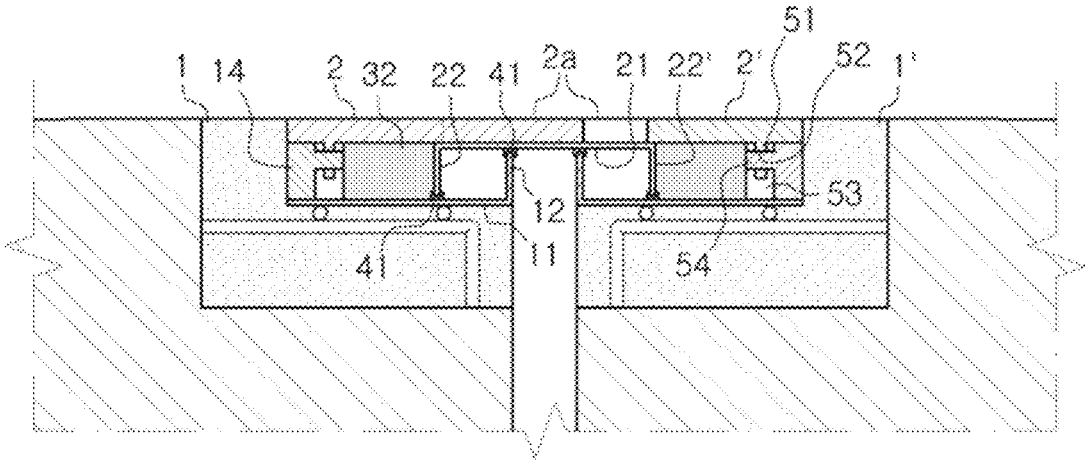

Referring to FIGS. 7A-7B, the present disclosure may further include separation prevention means 50 of the finger plates 2 and 2' in order to prevent a problem, such as that each of the finger plates 2 and 2' having a rear end thereof assembled to the finger assembly mount 14 by the bolts soars to the top due to stress occurring upon expansion and contraction or expansion action of each of the upper plates 1 and 1'.

To this end, the separation prevention means 50 has a fastener 51 downward protruded formed in plural in the length direction thereof at the rear end thereof on the bottom of each of the finger plates 2 and 2'. A pin hole 52 is penetrated through a fastener 51.

Furthermore, a plurality of insertion grooves 53 is formed in the length direction of the finger assembly mount 14 so that the fasteners 51 of the finger plates 2 and 2' are fit into the insertion grooves 53. A coupling pin 54 fit into the pin hole 52 of the fastener 51 is constructed in the insertion groove 53 in a way to protrude toward the finger parts 2*a*.

The separation prevention means 50 according to the present disclosure forms a structure whose side at the rear end thereof is constrained along with a coupling force by which the finger plates 2 and 2' are fastened to the upper side of the finger assembly mount 14 by the bolts due to the structure the fasteners 51 of each of the finger plates 2 and 2' are inserted into the insertion grooves 53 of the finger assembly mount 14 and the coupling pins 54 have been fit into the pin holes 52. Accordingly, upon contraction action of the upper plates 1 and 1' of the bridge in the winter season, a shock of dynamic loading of a traveling vehicle applied to the finger parts 2*a* in the state in which the finger plates 2 and 2' have been isolated from each other is distributed to the upper plates 1 and 1', thereby preventing the bolts coupled to the finger assembly holes 13 from being damaged. Although the bolts are damaged due to a shock, the separation prevention means 50 can prevent the finger plates 2 and 2' from being detached, such as upward soaring, by holding the sides of finger plates 2 and 2'. Accordingly, a secondary vehicle accident which may occur when the finger plate 2 or 2' soaring to the top and is detached can be prevented.

As described above, the present disclosure can structurally prevent an alien substance or water from being introduced into the isolated space between the pair of finger plates. Accordingly, there can be provided the expansion joint having easy installation and not having repair and maintenance attributable to a problem with the drainage sheet part because a separate drainage sheet part is not necessary.

Figure 8:
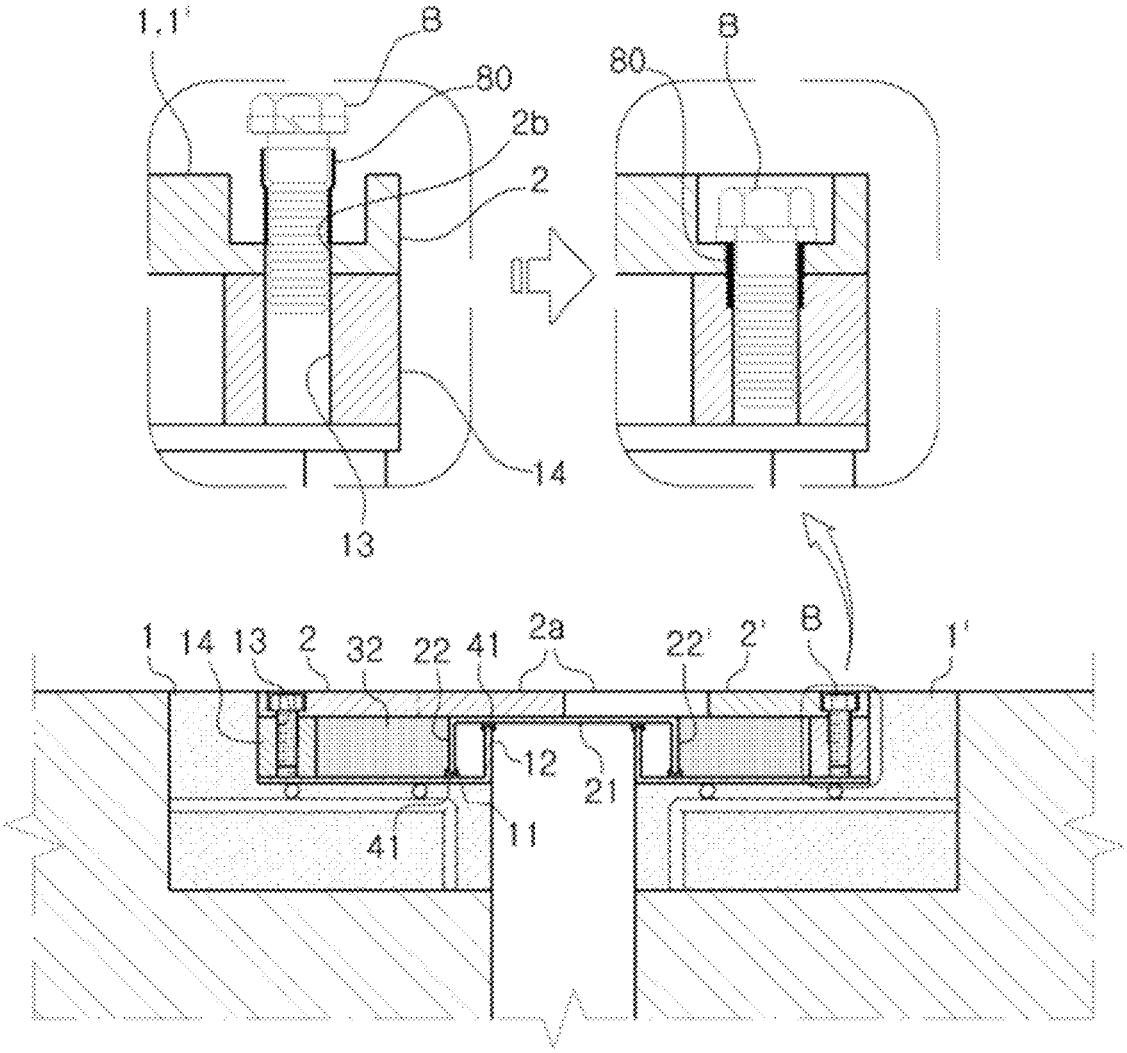
FIG. 8 is a construction diagram illustrating the state in which a rubber tube has been applied to the expansion joint according to the present disclosure.

Referring to FIG. 8, the expansion joint of the present disclosure may further include a rubber tube 80 installed on the outer circumference surface of the bolt B and providing sealing between the finger plates 2 and 2' and the finger assembly mount 14 and between the bolt B and the finger assembly holes 13.

In this case, the rubber tube 80 is formed of an elastic tube and fit and coupled on the outer circumference surface of the bolt B or formed by coating the outer circumference surface of the bolt B with an elastic layer. In this case, the rubber tube 80 is locally formed in some section of a male screw part on the head part side of the bolt B.

Accordingly, when the finger plates 2 and 2' are mounted on the finger assembly mount 14 by using the bolts B, the rubber tube 80 is engaged between the male screw part of the bolt B and the female screw part of the finger assembly holes 13. Furthermore, as in an enlarged view of FIG. 8, a part of the rubber tube 80 is climbed and rolled up by the bolt B and expanded, thus sealing the space between the bolt B and a hole 2*b* of the bolt. Accordingly, watertightness is highly improved, and damage to and a release phenomenon of the bolt B are prevented because the loading of a traveling vehicle applied to the finger plates 2 and 2' is absorbed.

Figure 9A:
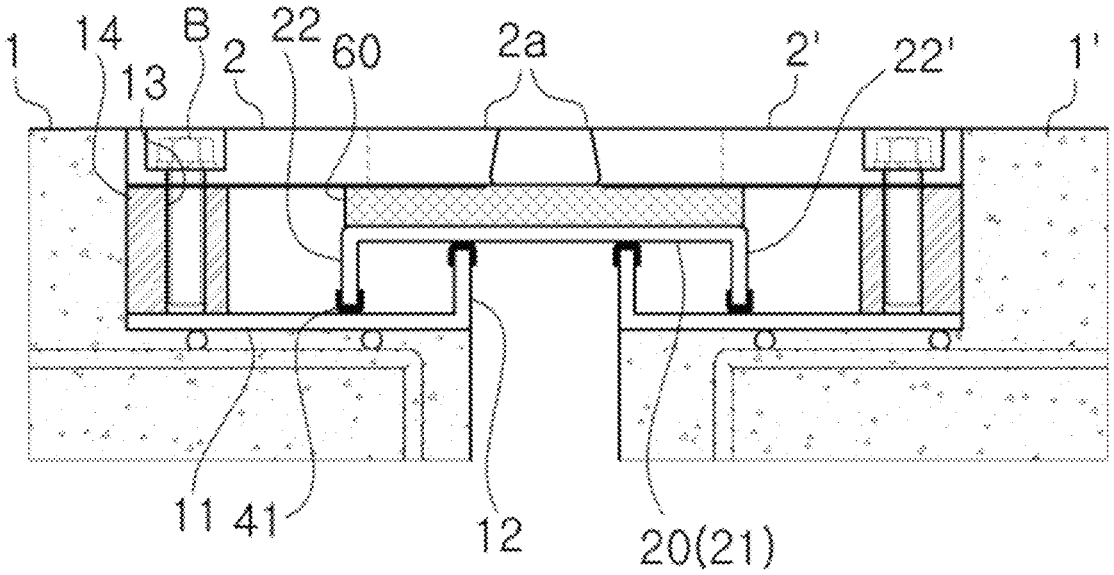
FIGS. 9A-9B are diagrams construction diagrams illustrating an end gradient pad of the expansion joint according to the present disclosure.
Figure 9B:
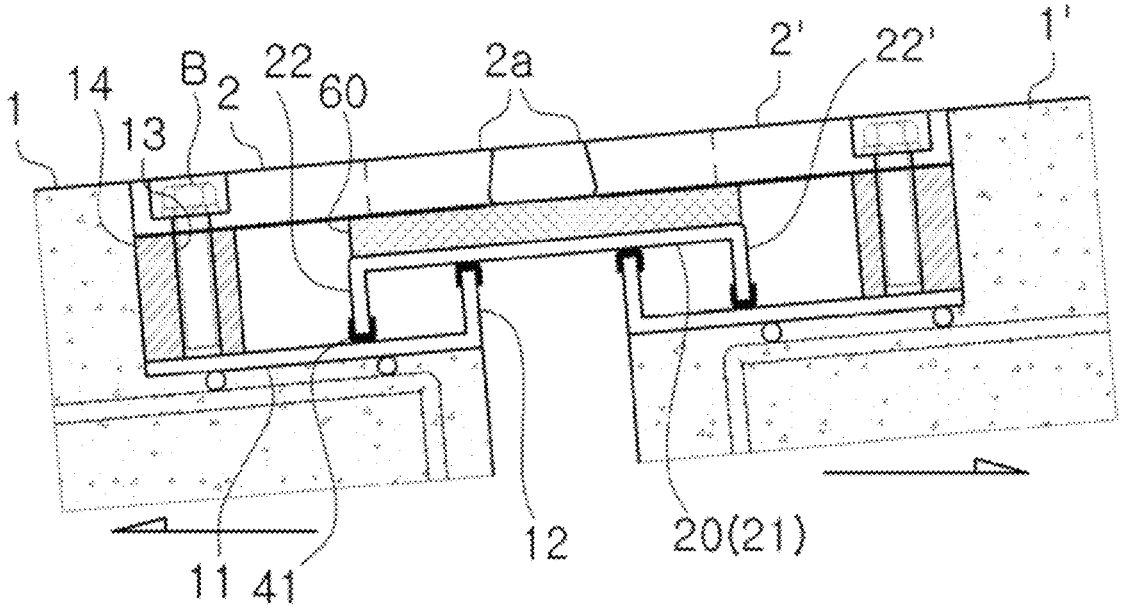

Referring to FIGS. 9A-9B, the expansion joint of the present disclosure may include an end gradient pad 60 installed on the top of the connection block plate 20 to mitigate and support the bottom of the finger plates 2 and 2' and also to provide blocking between the finger parts 2*a*. The end gradient pad 60 is made of a compressible elastic body, such as rubber or foam, and is formed to have a width identical with or smaller than the width of the cover plate 21 of the connection block plate 20.

Furthermore, the end gradient pad 60 is integrated and attached to the top of the cover plate 21 of the connection block plate 20, and is installed when the connection block plate 20 is assembled upon a site construction. Thereafter, the end gradient pad 60 is fixed to the cover plate 21 of the connection block plate 20, and is prevented from being moved.

That is, as in FIG. 9A, in applying the end gradient pad 60, as the lengths of the seated supports 22 and 22' are reduced as much as the thickness of the end gradient pad 60, a space for the end gradient pad 60 is secured between the top of the cover plate 21 of the connection block plate 20 and the bottom of the finger plates 2 and 2'.

Since the finger plates 2 and 2' are mitigated and supported by the end gradient pad 60, noise and a shock attributable to vehicle traffic are absorbed, a load applied to the bolt B is reduced, and damage to and the release of the bolt B are prevented. Furthermore, as the end gradient pad 60 is flexibly and elastically deformed, the gap between the finger parts 2*a* of the finger plates 2 and 2' is tightly closed on the lower side. Accordingly, there is an advantage in that the introduction of an alien substance including water is conjunctly blocked.

FIG. 9B illustrates a case where the expansion joint is installed in a section inclined at a given angle. Expansion and contraction movements of the finger plates 2 and 2' constituting the expansion joint are always performed horizontally without being performed along the inclined surface. If the end gradient pad 60 is not provided in the expansion joint of an inclined bridge, the bridge is extended in summertime, so that the bottom of the finger plates 2 and 2' collides against or interfere with the cover plate 21. As a result, smooth expansion and contraction actions are not performed, and damage to the bridge is caused.

If the finger type expansion joint of the present disclosure is applied to a bridge having a gradient, however, the finger plates 2 and 2' are horizontally moved in response to expansion and contraction movements of the bridge. Although the gap between the finger parts 2*a* of the finger plates 2 and 2' and the cover plate 21 of the connection block plate 20 is reduced, the end gradient pad 60 can be flexibly elastically (compressively) deformed, so that the finger plates 2 and 2' can flexibly absorb the horizontal movement. Furthermore, the gap between the finger parts 2*a* of the finger plates 2 and 2' is conjunctly blocked, and damage attributable to friction between the finger parts 2*a* and the cover plate 21 is prevented.

Meanwhile, according to the present disclosure, since the expansion joint is exposed to the outside and expansion and contraction thereof are repeatedly performed in response to a temperature change, storm water may permeate into the first support member 10 and the second support member 10'.

Figure 10:
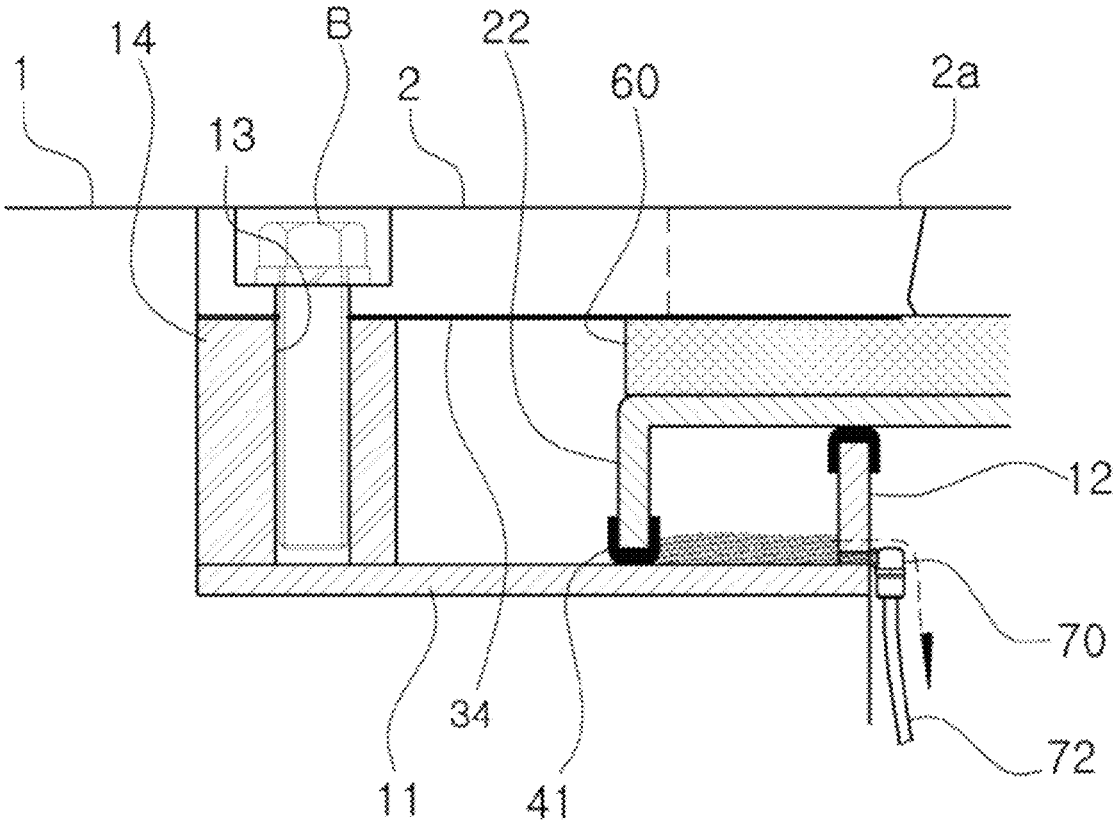
FIG. 10 is a construction diagram illustrating tube fitting of the expansion joint and a drainage pipe according to the present disclosure.

The permeated storm water can be absorbed and quickly dried by the elastic foam 31 or can be discharged to the outside by a separate drainage facility as illustrated in FIG. 10.

To this end, a tube fitting 70 for drainage is installed below the vertical support 12, and includes a drainage pipe 72 having one end fastened to the tube fitting 70 in a one-touch way and the other end extended to the outside of the first and second support members 10 and 10' to drain, to the outside, an alien substance stagnated in the first and second support members 10 and 10'. The tube fitting 70 is disposed in plural in the length direction of the vertical support 12, that is, in the width direction of the bridge in which the finger type expansion joint is installed. The plurality of tube fittings 70 is provided to be extended to the outside of the bridge by the drainage pipe 72.

Although an alien substance including water is introduced into an internal space formed in the vertical support 12 and the seated supports 22 and 22', damage, such as the corrosion of the first and second support members 10 and 10' and the connection block plate 20, can be prevented because the water is rapidly drained to the outside through the tube fitting 70 and the drainage pipe 72.

Although the most preferred embodiments of the present disclosure have been described in the detailed description of the present disclosure as described above, the present disclosure may be variously modified and implemented without departing from the technical range of the present disclosure. Accordingly, the scope of protection of the present disclosure should not be limited and determined by the embodiments, but should be recognized based on techniques of the appended claims and even equivalent technical means thereof.

INDUSTRIAL APPLICABILITY

The finger type expansion joint not having a drainage sheet provided in the present disclosure is a technology having great industrial applicability, which can be very conveniently constructed and rarely requires repair and maintenance because a drainage sheet part that must be separately installed to drain water and contain an alien substance in a conventional technology does not need to be installed, by preventing rainwater or an alien substance from being drained into the isolated space between the finger plates.

What is claimed is:

1. A finger type expansion joint not having a drainage sheet, comprising:

first and second support members (10, 10') in each of which a vertical support (12) is upward erect at one end of a sheet-shaped base plate (11) and a finger assembly mount (14) is disposed at the other end of the base plate (11) so that finger plates (2, 2') are assembled by bolts (B) and are installed in upper plates (1, 1') on both sides of a bridge which face an isolated space, respectively;

a connection block plate (20) which is installed to interconnect the first and second support members (10, 10') to each other, support bottoms of the finger plates (2, 2'), and block water or an alien substance from being discharged between finger parts (2*a*) by providing blocking between the finger parts (2*a*);

a gap maintenance member (30) which is interposed between the first and second support members (10, 10') and the connection block plate (20), wherein the gap maintenance member (30) places a location of the connection block plate (20) in a middle of the first and second support members (10, 10') by an elastic action; and a tube fitting (70) for drainage installed below the vertical support (12), wherein the tube fitting (70) includes a drainage pipe (72) having one end connected to the tube fitting (70), the other end extended to an outside of each of the first and second support members (10, 10') to discharge, to an outside, the alien substance stagnated in each of the first and second support members (10, 10').

2. The finger type expansion joint of claim 1, wherein the connection block plate (20) comprises a sheet-shaped cover plate (21), wherein seated supports (22, 22') downward erect in a way to be closely attached to the base plates (11) of the first and second support members (10, 10') at both ends of the sheet-shaped cover plate (21), respectively, wherein the seated supports (22, 22') are constructed in the connection block plate (20) to cover and connect the first and second support members (10, 10'), respectively.

3. The finger type expansion joint of claim 1, wherein the gap maintenance member (30) is an elastic foam (31), wherein the elastic foam (31) comprises one or more of an outside elastic foam (32), wherein the outside elastic foam (32) is interposed between each of the seated supports (22, 22') and the finger assembly mount (14) to maintain a gap by an elastic action, wherein the connection block plate (20) is positioned in the middle of the elastic foam (31) or inside an elastic foam (33), wherein the elastic foam (33) interposed between each of the seated supports (22, 22') and the vertical support (12).

4. The finger type expansion joint of claim 3, wherein a protection cover (34) is further constructed at a bottom of each of the finger plates (2, 2') to prevent the elastic foam (31) from being directly exposed to an outside.

5. The finger type expansion joint of claim 2, further comprising packing means (40) for blocking water from being penetrated into a contact portion of the connection block plate (20) and each of the first and second support members (10, 10'), wherein the packing means (40) comprises a leakage prevention cap (41) fit into a bottom of each of the seated supports (22, 22') closely attached to the base plate (11) or a top of the vertical support (12) closely attached to the sheet-shaped cover plate (21) and compressed to form a sealing structure when pressurized by a load of each of the finger plates (2, 2') in order to prevent water leakage and distribute a load.

6. The finger type expansion joint of claim 1, further comprising a rubber tube (80) installed on an outer circumference surface of the bolt (B) to provide sealing between each of the finger plates (2, 2') and the finger assembly mount (14) and between the bolt (B) and the finger assembly hole (13).

* * * * *